US005505406A

United States Patent [19]

Summey, III

[11] Patent Number: 5,505,406

[45] Date of Patent: Apr. 9, 1996

[54] APPARATUS AND METHOD FOR POSITIONING A WEB ROLL

[75] Inventor: Shala W. Summey, III, Greenville, S.C.

[73] Assignee: Alexander Machinery, Inc., Mauldin, S.C.

[21] Appl. No.: 222,231

[22] Filed: Apr. 4, 1994

[51] Int. Cl.[6] ..... B65M 19/12

[52] U.S. Cl. ..... 242/563.1

[58] Field of Search ..... 242/554.1, 555.1, 242/558, 559, 560, 560.2, 561, 563, 563.1, 564, 564.5, 566; 414/911; 198/340, 365, 372

[56] References Cited

U.S. PATENT DOCUMENTS

| | | | |
|---|---|---|---|
| 3,537,662 | 11/1970 | Keesling et al. | 242/563.1 |
| 3,556,425 | 1/1971 | Keesling et al. | 242/563.1 |
| 3,977,617 | 8/1976 | Salmon | 242/561 |
| 4,543,152 | 9/1985 | Nozaka | 242/563.1 |
| 4,951,894 | 8/1990 | Young, Jr. et al. | 242/564 |
| 5,096,135 | 3/1992 | Eichenberger et al. | 242/563 |
| 5,133,511 | 7/1992 | Mack et al. | 242/554 |
| 5,209,418 | 5/1993 | Alexander, III | 242/558 |
| 5,308,217 | 5/1994 | Pienta | 414/911 |
| 5,330,126 | 7/1994 | Grischenko | 242/559 |
| 5,393,009 | 2/1995 | Neri | 242/561 |

*Primary Examiner*—John P. Darling
*Attorney, Agent, or Firm*—Ralph Bailey

[57] ABSTRACT

Apparatus and method for centering a web roll includes providing a support (A) for carrying the web roll in longitudinal alignment with a driven belt forming a cradle supporting the web roll for unwinding and winding the web. The support (A) includes a conveyor having a motor (C) producing relative transverse movement between the web roll and the driven belt in response to a signal from a detector (B) in a direction toward centering the web roll in respect to the driven belt. A second detector (D) is movable in and out together with the first detector for sensing the other edge of the fabric for discontinuing the relative transverse movement. The support (A) includes a conveyor and a lift and tilt mechanism for placing the web roll upon a table preparatory to moving same onto the cradle for unwinding.

11 Claims, 6 Drawing Sheets

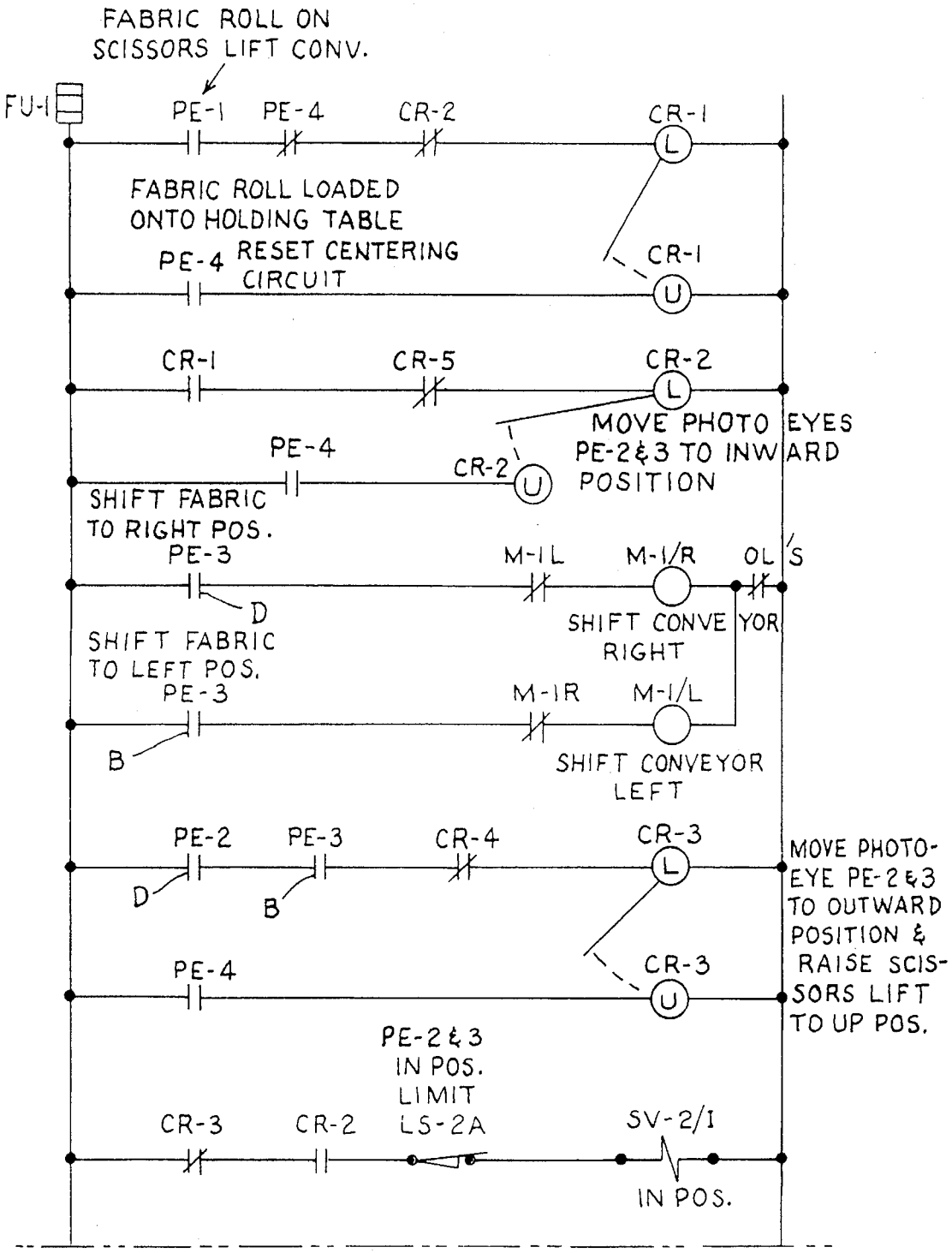
*Fig. 4-A.*

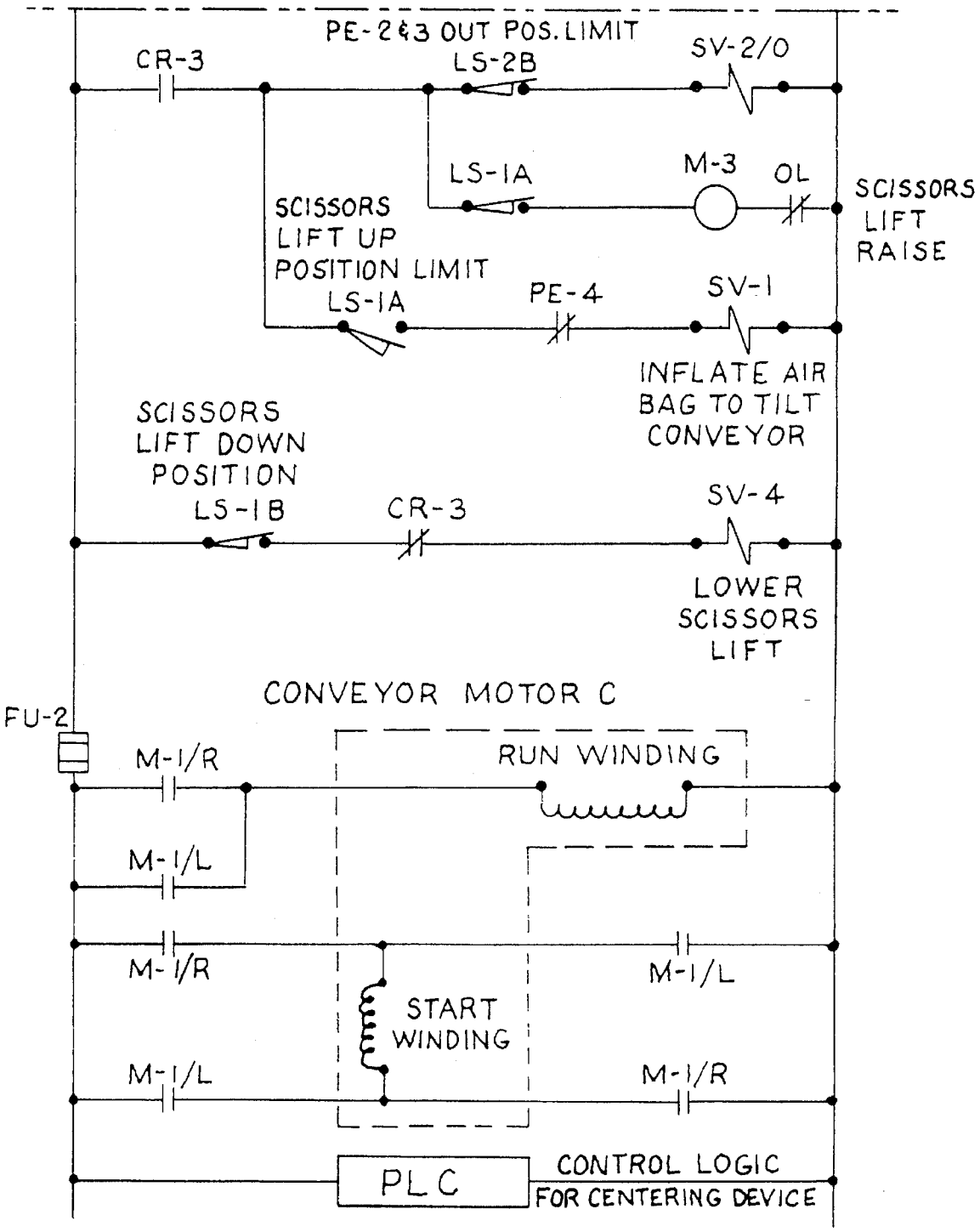
*Fig. 4-B.*

APPARATUS AND METHOD FOR POSITIONING A WEB ROLL

BACKGROUND OF THE INVENTION

This invention relates to apparatus and method for positioning a web roll upon a belt letoff and the like, and is an improvement upon apparatus illustrated in U.S. Pat. No. 5,209,418.

A web roll may be placed upon a tilted table for gravity feeding the web roll upon a cradle formed by a driven belt carried between a pair of parallel horizontal rolls mounted for rotation upon a fixed frame wherein one of the rolls is pivoted downwardly to lower one side of the cradle for receiving the web roll preparatory to unwinding. While letoffs constructed in accordance with the aforesaid patent are useful in unwinding web rolls usually consisting of cloth, it is desirable to provide an apparatus and method for centering the web roll for placement upon a table for gravity feeding same upon the belt and thence within the cradle of a belt letoff.

Web rolls utilized in the textile industry are extremely large, heavy and difficult to manipulate. The prior art contemplates the delivery of the web rolls as upon lift trucks for deposit upon a tilted table for feeding and delivering same to the belt of a belt letoff. The proper centering of these rolls is usually done by trial and error requiring considerable manual manipulation often resulting in inaccuracies in centering the rolls upon the belt letoff. The invention hereof contemplates apparatus and method including a pair of spaced detectors for centering the web roll through the use of apparatus for simultaneously moving the pair of detectors in or out together. The invention further contemplates the use of a driven conveyor which is manipulated responsive to signals from the detectors preparatory to actuation of tilt mechanism for lifting the web roll thus centered upon the cradle of the belt letoff.

While the invention is described herein in connection with the centering of a web roll for use in unwinding utilizing a belt letoff, other uses of the invention may be undertaken wherein it is desirable to center a web roll as upon a winding or dewinding apparatus for further manipulation of the web.

SUMMARY OF THE INVENTION

Accordingly, it is an important object of this invention to provide a centering apparatus and method for manipulating web rolls wherein the rolls are delivered to a scissors lift mechanism including a driven conveyor for carrying the web roll for transverse adjustment preparatory to gravity feeding the web roll centrally upon a winder, dewinder and the like.

Another important object of the invention is the method of centering a new web roll for delivery to a web manipulating mechanism for winding or unwinding the web roll including a cradle formed by a belt carried between spaced horizontal rolls for supporting the web roll and for facilitating doffing of an exhausted web roll core and the like preparatory to placement of the new web roll which has already been centered in respect to the web manipulating mechanism.

Still another important object of the invention is to provide a scissors lift mechanism which carries a tilt apparatus including a driven conveyor for centering a web roll in respect to a winding and dewinding apparatus.

Another important object of the invention is to provide apparatus for centering a web roll including a first detector which is movable transversely toward a web roll carried in transverse alignment with a winder or dewinder mechanism. A second detector moves in or out simultaneously with the first detector and detects the other edge of the web roll and signals the need for discontinuing transverse axial movement of the web roll.

The conveyor is driven by a motor capable of driving the conveyor in either direction depending upon which of the pair of sensors detects the adjacent end of the web roll first. The motor is driven in response to signals from the respective detectors.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a front perspective view of the apparatus and method illustrating the manipulation of first and second detectors for sensing an edge of the web roll initiating movement of a drive mechanism including a transverse conveyor for centering the web roll preparatory to delivering same to a winder or dewinder and the like;

FIG. 4 is a circuit diagram illustrating the operation of the various electrically operated components whereby the web roll is positioned upon a tiltable conveyor driven transversely in respect to a winding mechanism in response to detectors movable in and out together for centering the web roll longitudinally with delivery of the web roll and positioning thereof preparatory to winding or unwinding.

DESCRIPTION OF A PREFERRED EMBODIMENT

The drawings illustrate apparatus and method for centering a web roll for placement upon a driven belt forming a cradle between a pair of spaced horizontal support rolls **10*a* carried for rotation in the frame 10*b***. A support A carries the web roll in transverse alignment with the driven belt. A first detector B is movable transversely toward the web roll. A second detector D is movable in and out transversely together with the first detector for sensing the other edge of the web roll. Drive means C produces relative transverse movement, between the web roll and the driven belt in response to a signal from the detector which first senses an end of the web roll, toward centering of the web roll in respect to the driven belt. A second signal in response to the other detector controls the drive motor for discontinuing the relative transverse movement. Thus, the web roll and the driven belt are positioned in longitudinal alignment preparatory to placing the web roll upon the driven belt for unwinding the web roll. The support A includes suitable lifting mechanism for elevating the web roll on to the cradle.

Figure 1:
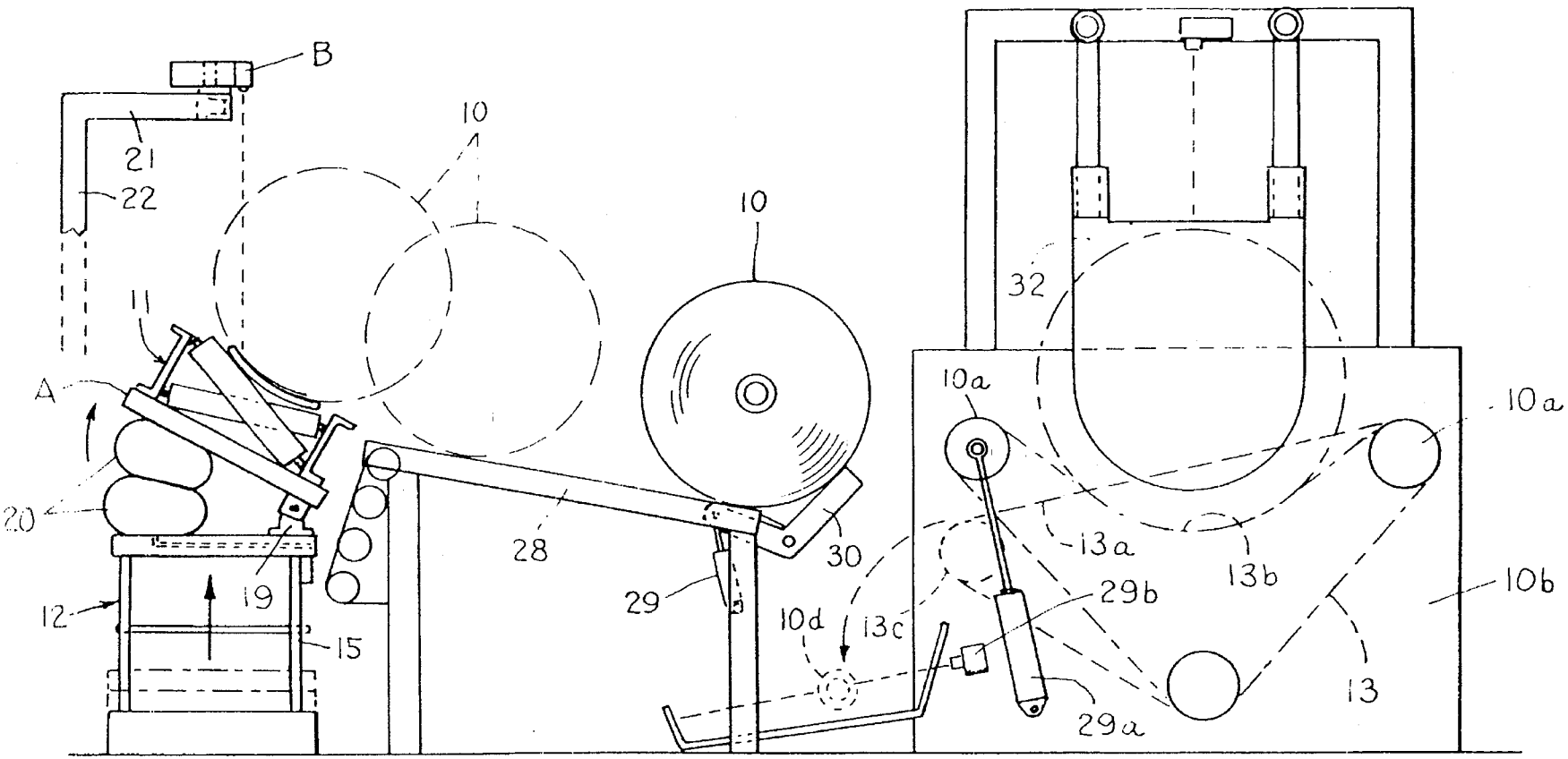
FIG. 1 is a side elevation illustrating apparatus and method for positioning a web roll constructed in accordance with the invention for positioning a full web roll upon a belt unwinder utilizing a tilted table for gravity feeding the full web roll upon a cradle formed by the belt wherein one of the transverse support rolls has been lowered for doffing a core roll preparatory to placing the centered roll upon the cradle.

Referring more particularly to the drawings, a web roll 10 is illustrated in broken lines in FIG. 1 as being carried by a tiltable conveyor broadly designated at 11 forming, together with the scissors lift broadly designated at 12, the support A for positioning the web roll in transverse alignment with the driven belt 13 of a belt letoff. The belt 13 is shown in broken lines in extended lowered position at 13*a* for doffing a core 10*d* (FIG. 1) preparatory to receiving a full web roll in a cradle 13*b*, also shown in broken lines. The tiltable conveyor 11 is carried upon the scissors lift 12. The conveyor 11 has a drive means including the drive motor C. The web roll 10 is shown in broken lines rolling off the conveyor 11 to full line position against the gate 30 preparatory to being fed by gravity onto the belt 13.

Figure 3:
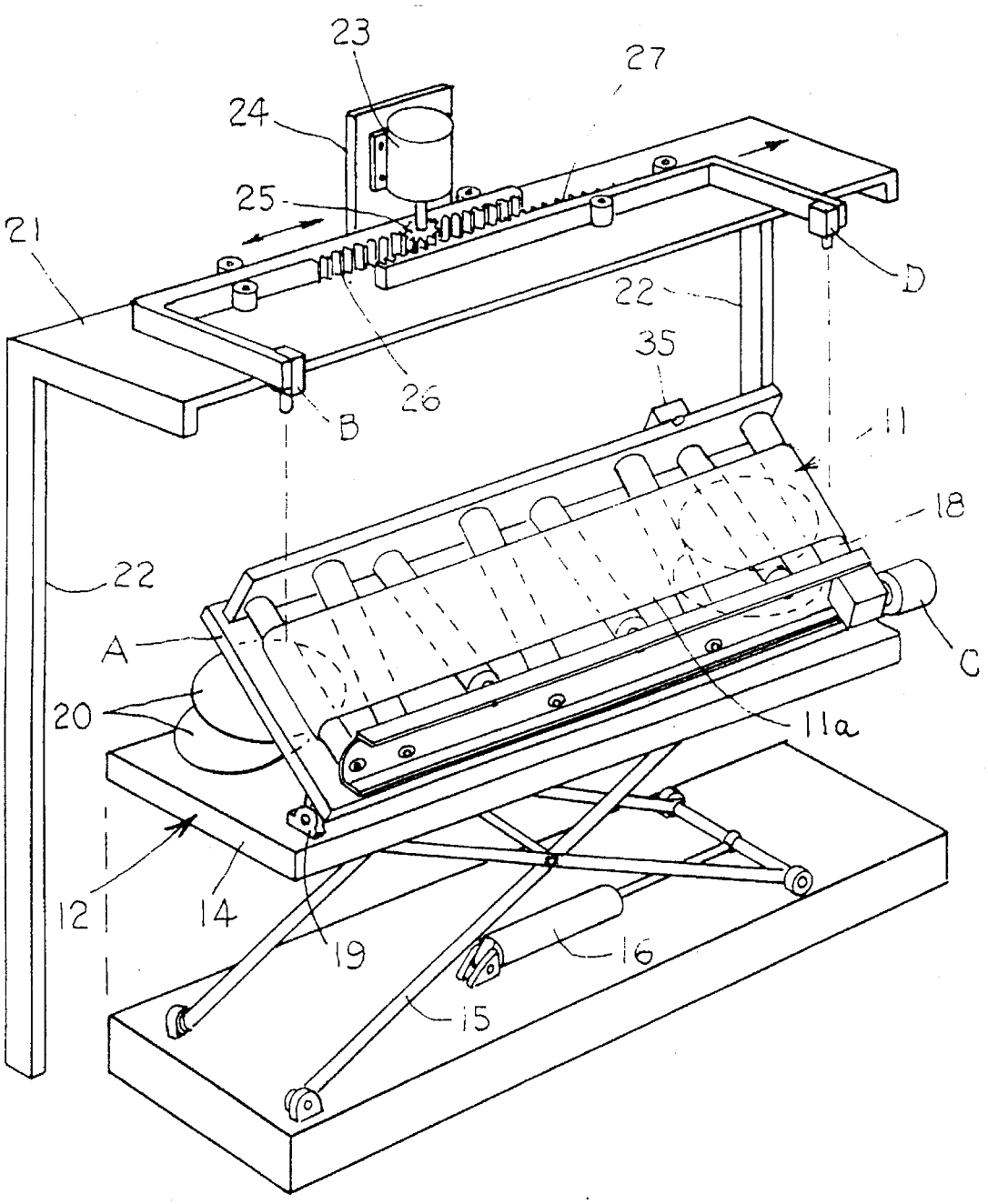

The apparatus and method, including the support A for delivering the web roll 10, is best illustrated in FIG. 3 as including the driven conveyor belt 11*a*. The conveyor in this embodiment of the invention is illustrated as a troughed roll conveyor. The scissors lift mechanism 12 includes a support table 14 carried by scissors linkage 15 which is raised and lowered by the hydraulic motor 16. The roll 10 is carried by a belt 11*a* of the conveyor 11. The belt 11*a* is carried by rolls 17 and 18. The roll 18 is illustrated as being driven by the motor C. The conveyor 11 is tiltably mounted upon the support table 14 on spaced pillow block bearings 19. Suitable tilting force is supplied by the air bags 20 for tilting the conveyor support in the direction of the arrow in FIG. 1 to the tilted position of FIG. 3.

The detectors B and D are suitably positioned in relation to the web roll 10 to sense first one edge which will initiate movement of the conveyor 11 towards centering of the web roll 10, in a direction depending upon which of the detectors B or D contact an end of the web roll 10 first. This is followed by cessation of this movement caused by a signal from the other sensor sensing the other end of the web roll 10. The sensors B and D are moved in and out together on a common moveable means such as a drive belt or by the rack and pinion apparatus illustrated herein. The sensors B and D are preferably carried above the web roll on a bridging member such as the shelf 21. The conyeyor 11 is thus positioned for centering the web roll. A pair of spaced vertical supports 22 carry the bridging member 21.

Suitable rack and pinion apparatus is driven by a motor 23 carried by a bracket 24 positioned upon the bridging member 21. The motor 23 is illustrated as driving a pinion gear 25 for manipulating the respective rack members 26 and 27 for moving the sensors B and D in and out together for exerting a centering action upon the fabric roll 10.

After the fabric roll is loaded onto the scissors lift 12, the detectors B and D are moved toward the fabric roll. Depending on which detector contacts the fabric roll first, the belt 11*a* will move fabric roll towards center position until the other detector contacts the fabric roll 10. When both detectors are blocked, this will stop the conveyor. Both detectors are thus located on a common drive which moves both in or out together.

Figure 2:
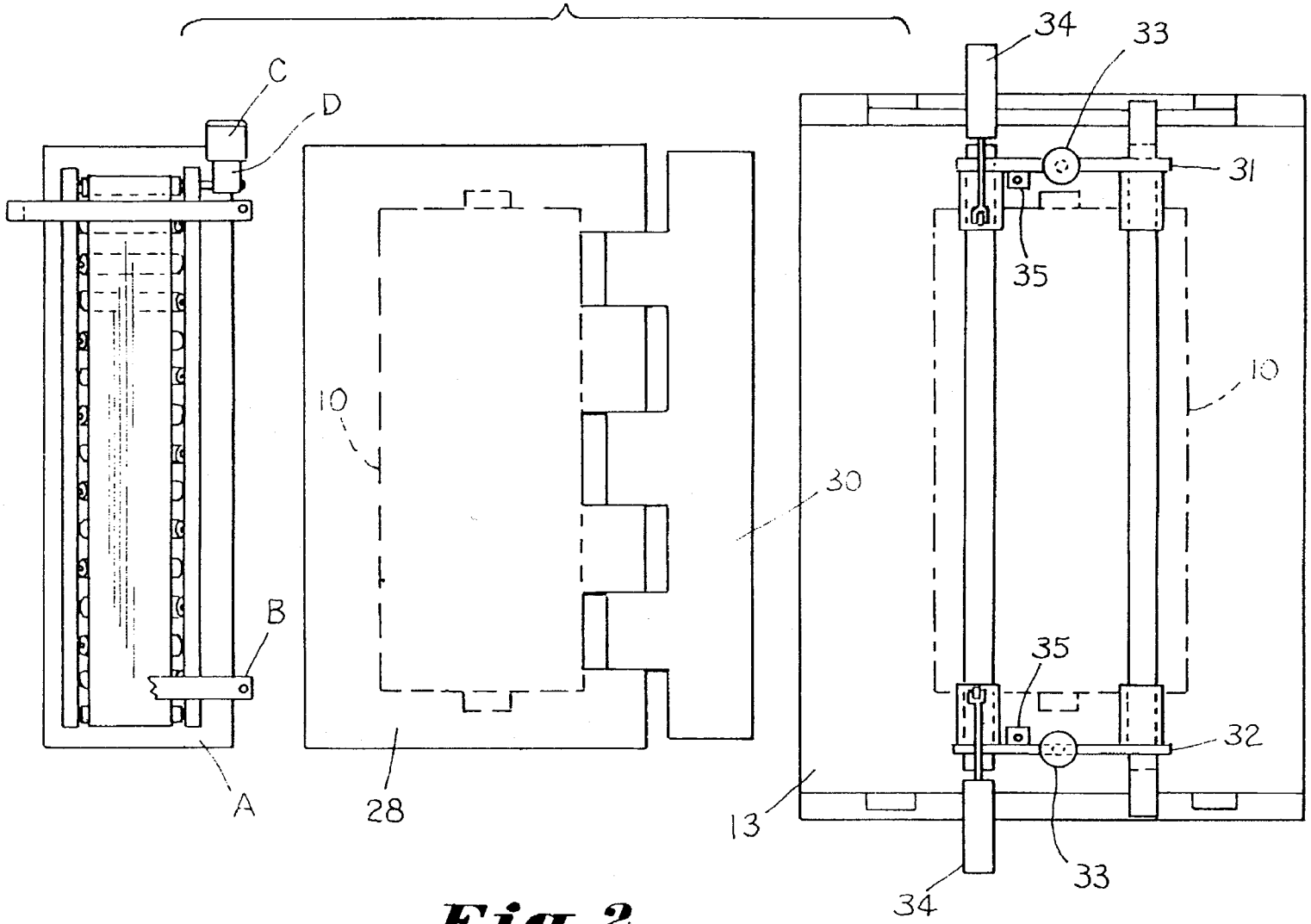
FIG. 2 is a plan view further illustrating the web centering apparatus constructed in accordance with the invention as illustrated in FIG. 1.

After the fabric roll is loaded on the conveyor belt 11*a*, the gate 30 carried at the end of the tilted table 28 is automatically raised by the cylinder 29 responsive to a signal from the sensor 35 and both core guides 31 and 32 (FIGS. 1 and 2) are lowered to position shown in FIG. 1 by the cylinders 33 and toward the fabric roll by the cylinders 34 (FIG. 2). Suitable detectors such as photoeyes or ultrasonic sensors 35 located on the core guides detect the fabric edge and stop the core guides automatically.

Other means such as a centering device (not shown) on the holding table may be used. Also apparatus (not shown) moving the belt letoff or traction roll letoff from side to side may be used.

Referring to FIG. 4, after the fabric roll is loaded onto conveyor, PE-1 detects the fabric roll and latches relay CR-1. CR-1 then latches CR-2 which operates solenoid SV-2/I to move both PE-2(B) and PE-3(D) to the inward position. Conveyor motor starter M-1/R (right) and M-1/L (left) are controlled by the photoeyes PE-2 and PE-3. The conveyor moves left or right depending on which photoeye detects the fabric roll first. Once the roll is centered both. PE-2 and 3 detect the fabric roll. This latches relay CR-3. CR-3 then activates solenoid SV-2/O (out) and deactivates solenoid SV-2/I (in). This moves PE-2 and PE-3 back to the out position until limit switch LS-2B is opened. CR-3 also activates motor starter M-3 to cause the hydraulic motor to raise the scissors lift. The scissors raises until limit switch LS-1A is activated. This in turn activates solenoid SV-1 to inflate air bag and tilt fabric roll onto the holding table. PE-4 is blocked by fabric roll after being tilted onto holding table. This resets all three latching relays CR-1,2 and 3 and energizes the solenoid SV-4 to lower the scissors lift and deflate the air bag.

Figure 5:
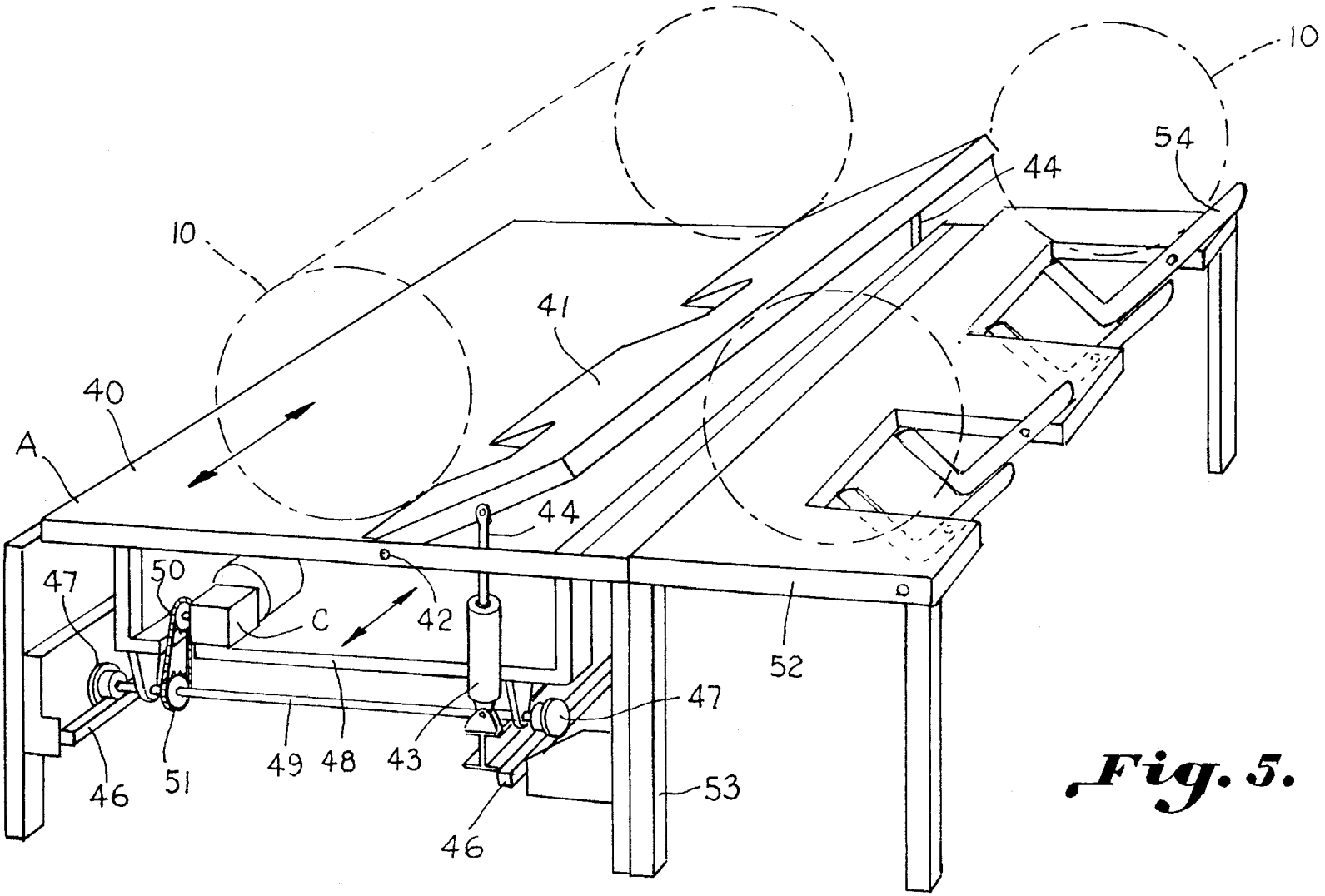
FIG. 5 is a perspective view illustrating a modified form of the invention wherein a transverse table mounted for transverse movement on rails serves as a conveyor for centering the web roll.

FIG. 5 illustrates a modified form of the invention wherein the support A is illustrated as including a forwardly inclined table which acts as a conveyor for moving the web roll transversely for centering in relation to the belt 13 of the letoff. The table A includes an inclined top 40 for receiving the web roll 10 and moving same forwardly by gravity against the gate 41 which is pivoted at 42. The gate 41 is raised and lowered by pneumatic cylinders 43 through extensible piston rods 44. The table top 40 is supported by legs 45 and beneath the table a pair of spaced longitudinal rods 46 extend transversely for supporting the table top 41 transversely for centering the web roll 10. The table top is supported upon the wheels 47 which roll upon the rails 46. A platform 48 suspended beneath the table top 40 carries an air motor C for driving the shaft 49 for driving the wheels 47 upon the rails 46. The motor C drives the shaft 48 as through a chain 50 which in turn drives a sprocket 51. An intermediate table 52 is supported by legs 53 intermediate the support A and the belt 13. When the belt 13 is in lowered position as shown in broken lines at 13*a* in FIG. 1 for receiving the roll 10, a pivoted gate 54 is lowered for permitting the web roll 10 to be received upon the belt 13. It will be observed that sensing mechanism including the sensors B and D have been provided in suitable relation to the ends of the web roll for operating the components illustrated in FIG. 5 as described above.

While a preferred embodiment of the invention has been described using specific terms, such description is for illustrative purposes only, and it is to be understood that changes and variations may be made without departing from the spirit or scope of the following claims.

What is claimed is:

1. Apparatus for centering a web roll for placement upon a driven belt forming a cradle between a pair of spaced horizontal support rolls comprising:

means supporting said web roll in transverse alignment with said driven belt;

a first detector movable transversely toward said web roll detecting an edge thereof and providing a first signal in response thereto;

drive means producing relative transverse movement between said web roll and said driven belt in response to said signal toward centering of said web roll in respect to said driven belt; and a second detector moving transversely together with said first detector for sensing the other edge of said web roll and providing a second signal in response thereto controlling said drive means for discontinuing said relative transverse movement;

whereby said web roll and said driven belt are positioned in longitudinal alignment preparatory to placing the web roll upon the driven belt for unwinding the web roll.

2. The structure set forth in claim 1 including power driven rack and pinion means moving said detectors transversely together.

3. The structure set forth in claim 1 wherein said drive means includes a transverse conveyor driven by a motor.

4. The structure set forth in claim 3 wherein said conveyor is carried by a lift means.

5. The structure set forth in claim 4 wherein said lift means is a scissors lift and tilt means carried by said scissors lift for tilting said conveyor for placing said web roll upon said driven belt.

6. The structure set forth in claim 3 wherein said conveyor includes an endless belt for receiving said web roll.

7. The structure set forth in claim 3 wherein said conveyor includes a table for receiving said web roll, mounted upon transverse rails, and power operated means moving said table in response to signals from said detectors.

8. The structure set forth in claim 7 wherein said table is inclined downwardly toward said belt drive including a gate retaining said roll, and an intermediate table between said first mentioned table and said belt for receiving said web roll from said first mentioned table for positioning upon said belt.

9. Apparatus for centering a web roll longitudinally in respect to transversely disposed winding apparatus comprising:

means supporting said web roll in transverse alignment with said winding apparatus;

first and second detectors positioned opposite respective ends of said web roll movable transversely toward said web roll detecting an edge thereof and providing a first signal in response thereto;

drive means producing relative transverse movement between said web roll and said winding apparatus in response to said signal toward centering of said web roll in respect to said winding apparatus;

means moving said detectors transversely together for sensing the other edge of said web roll and providing a second signal in response thereto controlling said drive means for discontinuing said relative transverse movement; and lift means carried by said drive means for lifting and placing said web roll in position to be received by said winding apparatus;

whereby said web roll and said winding apparatus are positioned in longitudinal alignment preparatory to placing the web roll upon the winding apparatus.

10. The method of centering a web roll for placement upon an operating apparatus comprising the steps of:

supporting said web roll in transverse alignment with said operating apparatus;

moving a first detector transversely toward said web roll detecting an edge thereof and providing a first signal in response thereto;

producing relative transverse movement between said web roll and said operating apparatus in response to said signal toward centering of said web roll in respect to said operating apparatus;

moving a second detector transversely together with said first detector sensing the other edge of said web roll and providing a second signal in response thereto controlling said drive means discontinuing said relative transverse movement; and raising and tilting the web roll for placing the web roll in position to be received by said operating apparatus;

whereby said web roll and said driven belt are positioned in longitudinal alignment preparatory to placing the web roll upon the operating apparatus for further manipulating of the web.

11. The method of centering a web roll for placement upon an operating apparatus comprising the steps of:

supporting said web roll in transverse alignment with said operating apparatus;

moving a first detector transversely toward said web roll detecting an edge thereof and providing a first signal in response thereto;

producing relative transverse movement between said web roll and said operating apparatus in response to said signal toward centering of said web roll in respect to said operating apparatus;

moving a second detector in and out transversely together with said first detector sensing the other edge of said web roll and providing a second signal in response thereto controlling said drive means discontinuing said relative transverse movement; and mounting a tiltable conveyor transversely upon a lifting mechanism for producing said relative transverse movement;

whereby said web roll and said driven belt are positioned in longitudinal alignment preparatory to placing the web roll upon the operating apparatus for further manipulating of the web.

* * * * *